US008063341B2

(12) United States Patent
Iwasaki

(10) Patent No.: US 8,063,341 B2
(45) Date of Patent: Nov. 22, 2011

(54) IMAGE FORMING APPARATUS

(75) Inventor: Atsushi Iwasaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 1019 days.

(21) Appl. No.: 11/625,923

(22) Filed: Jan. 23, 2007

(65) Prior Publication Data

US 2007/0175880 A1 Aug. 2, 2007

(30) Foreign Application Priority Data

Jan. 27, 2006 (JP) ..... 2006-018964

(51) Int. Cl.
*G03G 15/20* (2006.01)

(52) U.S. Cl. ..... 219/216; 219/486; 399/69; 399/329

(58) Field of Classification Search ..... None
See application file for complete search history.

(56) References Cited

U.S. PATENT DOCUMENTS

| | | | | |
|---|---|---|---|---|
| 4,415,800 | A * | 11/1983 | Dodge et al. | 219/497 |
| 5,149,941 | A | 9/1992 | Hirabayashi et al. | 219/216 |
| 5,300,997 | A | 4/1994 | Hirabayashi et al. | 355/285 |
| 5,343,280 | A | 8/1994 | Hirabayashi et al. | 355/285 |
| 5,512,993 | A | 4/1996 | Endo et al. | |
| 5,525,775 | A | 6/1996 | Setoriyama et al. | 219/216 |
| 5,682,576 | A * | 10/1997 | Sakai et al. | 399/69 |
| 5,767,484 | A | 6/1998 | Hirabayashi et al. | 219/216 |
| 6,040,558 | A * | 3/2000 | Yamazaki | 219/216 |
| 6,423,941 | B1 * | 7/2002 | Kanari et al. | 219/216 |
| 6,463,252 | B2 * | 10/2002 | Omoto et al. | 399/330 |
| 6,580,883 | B2 | 6/2003 | Suzumi | 399/69 |
| 7,283,145 | B2 * | 10/2007 | Kato et al. | 399/328 |
| 2002/0006296 | A1 * | 1/2002 | Omoto et al. | 399/330 |

FOREIGN PATENT DOCUMENTS

| | | |
|---|---|---|
| JP | 63-313182 | 12/1988 |
| JP | 4-44075 | 2/1992 |
| JP | 8-211769 | 8/1996 |
| JP | 10-177319 A | 6/1998 |
| JP | 2001-183929 | 7/2001 |
| JP | 2002-162847 | 6/2002 |

OTHER PUBLICATIONS

Chinese Office Action dated Dec. 19, 2008 in Chinese Application No. 2007100036959, and an English-language translation thereof.

* cited by examiner

*Primary Examiner* — Joseph M Pelham
(74) *Attorney, Agent, or Firm* — Fitzpatrick, Cella, Harper & Scinto

(57) ABSTRACT

The fixing apparatus of an image forming apparatus has a heating device, a feeding device and control device, wherein in a case of continuously forming images onto the material to be heated, wherein the control device changes the turn-on time ratio in accordance with a size of the material to be heated and determines the feeding timing of the material to be heated fed by said feeding device in accordance with temperature distribution of the heating device in a longitudinal direction of the heating member perpendicular to a conveying direction in which the material to be heated is conveyed. It can suppress the occurrence of wrinkles and can improve a throughput.

1 Claim, 6 Drawing Sheets

IMAGE FORMING APPARATUS

BACKGROUND OF THE INVENTION

1. Field of the Invention

The present invention relates to an image forming apparatus such as copying apparatus, laser beam printer, or the like.

2. Description of the Related Art

Hitherto, as a heating device (fixing apparatus) which is mounted in a copying apparatus or a laser beam printer, a film heating type apparatus disclosed in Japanese Patent Application Laid-Open No. S63-313182, H04-044075, or the like has been proposed and put into practical use.

According to such a film heating type fixing apparatus, a heat resistant thin film (fixing film) as a rotor for heating is closely adhered to a heating member by a rotor for pressing (pressing roller) and slid and conveyed, and a pressure-contact nip portion is formed by the heating member and the pressing roller so as to sandwich the fixing film. A material to be heated (hereinafter, referred to as a material to be heated) (transfer paper/sheet) which holds a non-fixed image is introduced to the nip portion, the material to be heated is conveyed together with the fixing film, and the non-fixed image is fixed as a permanent image onto the material to be heated by heat which is applied from the heating member through the fixing film and by a pressing force of the nip portion.

In the film heating type fixing apparatus, since the whole fixing apparatus can be constructed by a material of a low calorific capacity, electric power saving and a reduction in waiting time (quick start performance) can be realized.

For example, a plate-like ceramic base material of a low calorific capacity such as alumina ($Al_2O_3$), aluminum nitride (AlN), or the like is used for a base of the heating member. A heat generating pattern part using silver/palladium (Ag/Pd), $Ta_2N$, or the like and a power feeding electrode pattern part made of a material of a low resistance such as Ag or the like for electrifying the heat generating pattern part are formed onto one surface of the base material by screen printing or the like. Further, the surface formed with the heat generation circuit part is covered by a thin glass protecting layer.

The heating member generates the heat by electrifying the heat generating pattern part from the power feeding electrode pattern part and a temperature of the whole heating member rises rapidly. The risen temperature of the heating member is detected by a thermistor arranged in contact with or arranged near the heating member and is returned to an electrification drive control part. The electrification drive control part controls the electrification of the heat generating pattern part, thereby maintaining the heating member temperature detected by the thermistor to an almost predetermined temperature (target fixing temperature). That is, the electrification drive control part heats the heating member and controls its temperature so as to reach a predetermined fixing temperature.

Since the calorific capacity of such a kind of fixing apparatus is low, it is excellent in a rapid start. On the other hand, since the calorific capacity is low, the fixing apparatus has such a drawback that a heat amount which is taken away from the heating member differs largely in dependence on the portion. That is, in the case where a width in the longitudinal direction of the material to be heated (target which is heated by the heating member) (length of material to be heated in the direction which perpendicularly crosses the conveying direction of the material to be heated) is relatively narrower than a length of the heating member in the longitudinal direction, when comparing an area where the material to be heated passes (sheet pass-through part) with an area where the material to be heated does not pass (non-sheet pass-through part), the heat amount which is taken away from the heating member in the former area and that in the latter area differ remarkably. Although the heat amount is taken away by the material to be heated in the sheet pass-through part, it is not taken away by the material to be heated in the non-sheet pass-through part. As an example of the case where the width of material to be heated in the longitudinal direction is relatively narrower than the length of the heating member in the longitudinal direction, a case where the maximum sheet passage width is equal to a width of lateral pass-through sheet of the A4 size [width in the longitudinal direction is equal to 297 mm] and the width of material to be heated in the longitudinal direction is equal to a LEGAL size [width in the longitudinal direction is equal to 215.9 mm], a longitudinal pass-through sheet of the A4 size [width in the longitudinal direction is equal to 210 mm], or the like corresponds to such an example. In the present invention, the material to be heated whose width in the longitudinal direction is relatively narrower than the length of the heating member in the longitudinal direction is referred to as a material to be heated of a "small size" or "narrow width size" hereinbelow. Therefore, when the material to be heated of the narrow width size is allowed to pass through, the temperature of the non-sheet pass-through part where the heat amount is not taken away by the material to be heated rises gradually and what is called a phenomenon of temperature rising at the non-sheet pass-through part occurs. In the film heating system of the low calorific capacity, the temperature rising is large and exerts an adverse influence on the quality.

As one of the quality problems which are caused by the temperature rising at the non-sheet pass-through part, material to be heated wrinkles (also simply referred to as "wrinkles" or "paper wrinkles" hereinbelow) at the time of a continuous sheet passage of the material to be heated of the narrow width size can be mentioned. In the film heating system, since the temperature difference is caused between the sheet pass-through part and the non-sheet pass-through part due to the temperature rising at the non-sheet pass-through part, as for an outer diameter of the pressing roller which is generally made of an elastic member that is thermally expanded, a large difference is liable to occur between the sheet pass-through part and the non-sheet pass-through part. Therefore, a conveyance variation in the longitudinal direction of the film and, consequently, a conveyance variation of the material to be heated occur and the wrinkles are liable to occur in the material to be heated. It has been known that the wrinkles are particularly liable to occur in an environment such as a high-temperature and high-moisture environment or the like in which a rigidity of the material to be heated such as paper or the like is weakened.

SUMMARY OF THE INVENTION

A purpose of the invention is to provide an image forming apparatus which can suppress the occurrence of wrinkles with respect to a material to be heated whose width in the longitudinal direction is relatively narrower than a length of heating member in the longitudinal direction and can improve a throughput (the number of sheets which are conveyed per unit time).

Another purpose of the invention is to provide an image forming apparatus which can suppress the occurrence of wrinkles with respect to the material to be heated whose width in the longitudinal direction is relatively narrower than the length of the heating member in the longitudinal direction and can improve the throughput.

A further purpose of the invention is to provide an image forming apparatus comprising a heating device including a heating member having a plurality of heat generating members which independently generate heat on an elongated substrate, a moving member which moves in contact with the heating member, and a pressing member which forms a nip portion together with the heating member through the moving member and thereby heats an image on a material to be heated while sandwiching and conveying the material to be heated by the nip portion; a feeding device which feeds the material to be heated to said heating device; and control means which controls a heating timing of the heating member and a feeding timing of feeding the material to be heated fed by said feeding device, wherein in a case of continuously forming images onto the material to be heated, with respect to a turn-on time ratio defined by a heat generation amount allocated to a first heat generating member among the plurality of heat generating members and a heat generation amount allocated to a dependent heat generating member which dependently generates heat on the first heat generating member, said control means changes the turn-on time ratio in accordance with a size of the material to be heated and determines the feeding timing of the material to be heated fed by said feeding device according to temperature distribution of said heating device in a longitudinal direction of the heating member perpendicular to a conveying direction in which the material to be heated is conveyed.

A still further object of the present invention will become apparent from the following description of exemplary embodiments with reference to the attached drawings.

DESCRIPTION OF THE EMBODIMENTS

The invention will be described in detail hereinbelow with reference to the drawings.

Embodiment 1

(I) Example of Image Forming Apparatus

Figure 1:
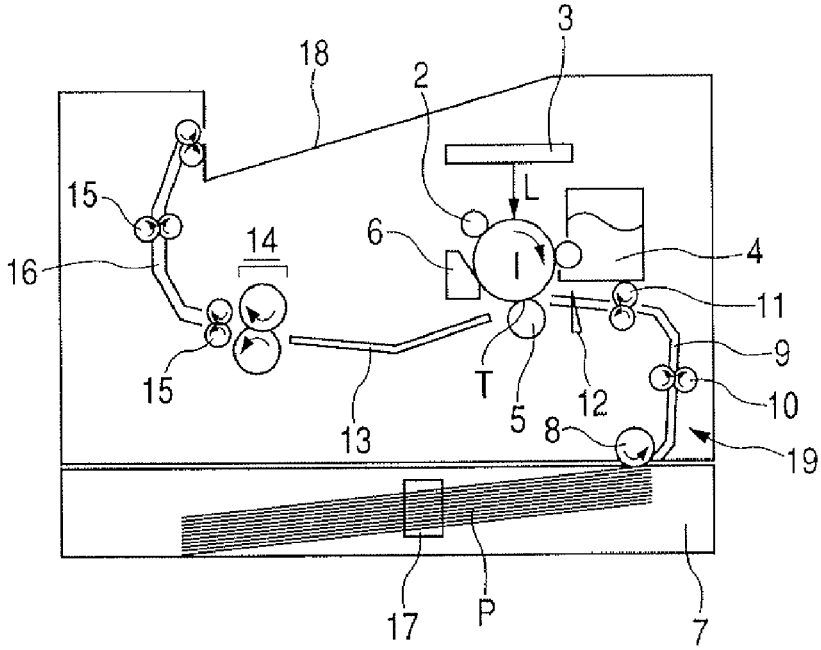
FIG. 1 is a schematic diagram of a schematic construction of an example of an image forming apparatus according to an embodiment 1.

FIG. 1 is a schematic diagram of a schematic construction of an example of an image forming apparatus according to the invention.

The image forming apparatus according to an embodiment is a laser printer using an electrophotographic system. According to this printer, a maximum sheet size of a sheet which can be used as a material to be heated (material to be heated) is equal to the A3 size, a conveying speed of the sheet is equal to 150 mm/sec, and the pass-through sheets of the A4 size in the lateral direction can be outputted at a ratio of 30 sheets/minute (ppm). The sheet conveyance is a center reference conveyance using a center line of the sheet in the longitudinal direction and the width direction and a center line of a length of heating member in the longitudinal direction. In the center reference conveyance, the sheet is conveyed in the state where the center line of the sheet in the longitudinal direction and the width direction and the center line of the length of the heating member in the longitudinal direction are made coincident.

The image forming apparatus has an electrophotographic photosensitive member of a drum type (hereinafter, referred to as a photosensitive drum) 1 as an image holding member. A charging roller (charging means) 2, a laser scanner unit (exposing means) 3, a developing apparatus (developing means) 4, a transfer roller (transfer means) 5, and a cleaning apparatus (cleaning means) 6 are arranged in this order around the photosensitive drum 1.

A sheet feeding cassette 7 on which sheets P are stacked and enclosed is arranged in a lower position of the image forming apparatus. A sheet feeding roller 8, a sheet feeding guide 9, a conveying roller 10, a registration roller 11, a top sensor 12, a conveying guide 13, a heating device 14, sheet discharging rollers 15, and a sheet discharging guide 16 are arranged in this order in a main body of the image forming apparatus along a conveying path of the sheet P which is fed from the sheet feeding cassette 7.

The sheet feeding roller 8, conveying roller 10, registration roller 11, and sheet discharging rollers 15 construct a feeding mechanism (feeding means) 19. A driving motor (not shown) and the like rotate those rollers through a gear train.

The operation of the image forming apparatus with the above construction will now be described.

When a controller (not shown) receives a print command from a host computer (not shown), the photosensitive drum 1 is rotated at a predetermined peripheral speed (process speed) in the direction shown by an arrow by driving means (not shown).

The charging roller 2 uniformly charges the outer peripheral surface (front surface) of the photosensitive drum 1 so as to have a predetermined polarity and a predetermined electric potential. An image exposure L based on an image signal is executed to the surface of the photosensitive drum 1 by the scanner unit 3, so that an electrostatic latent image according to the image signal is formed on the surface of the photosensitive drum 1.

Toner (developing agent) is selectively deposited onto the electrostatic latent image by the developing apparatus 4 and the electrostatic latent image is visualized as a toner image (development image). The toner image is conveyed to a transfer part T between the photosensitive drum 1 and the transfer roller 5 in association with the rotation of the photosensitive drum 1.

The sheet feeding roller 8 of the feeding mechanism 19 is rotated in the arrow direction by the motor and separates and feeds one of the sheets P in the cassette 7. In the embodiment, a sheet size detecting mechanism (material to be heated size detecting means) 17 to detect a size of sheet P is provided in the cassette 7. The sheet size detecting mechanism 17 detects the sheet size by an automatic detection of a position of a sheet size restricting plate in the cassette 7, a sheet size designation of a dial type, a sheet width sensor lever, or the like.

The sheet P which has been separated and fed by the sheet feeding roller 8 is conveyed to the registration roller 11 through the sheet feeding guide 9 by the conveying roller 10. The sheet P is conveyed to the transfer part T through the top sensor 12 by the registration roller 11. The sheet P has pushed down a lever of the top sensor 12 and it is detected here that a front edge of the sheet P has passed through the position of the top sensor 12. After that, the top sensor 12 continues to detect the sheet existence state until a rear edge of the sheet P has passed through the top sensor 12. When the rear edge of the sheet P has passed, the lever of the top sensor 12 is returned to the initial position and it is detected that the rear edge of the sheet P has passed through the position of the top sensor 12.

When the sheet P is conveyed to the transfer part T, in the transfer part T, an electric field whose polarity is opposite to that of the toner image on the surface of the photosensitive drum 1 is applied to the transfer roller 5. Thus, the toner image on the surface of the photosensitive drum 1 is transferred onto the sheet P.

The sheet P onto which the toner image has been transferred is guided to the conveying guide 13 and conveyed to the fixing apparatus (fixing unit) 14 as a heating device. The non-fixed toner image is heated and pressed here and fixed onto the surface of the sheet P.

The sheet P which has been subjected to the fixing process of the non-fixed toner image is ejected as image formed matter (print, copy) onto an external sheet discharging tray 18 through the sheet discharging guide 16 by the sheet discharging rollers 15.

Transfer residual toner remaining on the surface of the photosensitive drum 1 without being transferred onto the sheet P is removed by the cleaning apparatus 6 and the photosensitive drum 1 is used for the next image creation.

By repeating the above operation, the images can be successively formed.

(II) Fixing Apparatus 14

Figure 2:
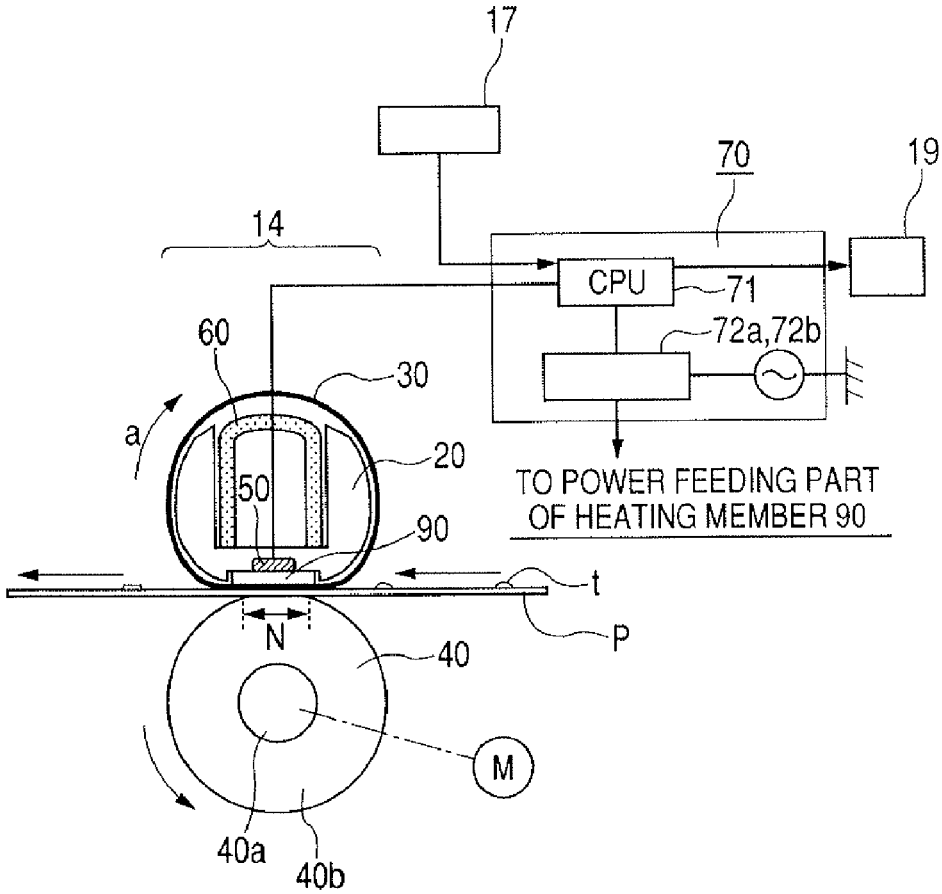
FIG. 2 is a schematic diagram of a cross sectional side elevational view of an example of a fixing apparatus.

FIG. 2 is a schematic diagram of a cross sectional side elevational view of an example of the fixing apparatus 14 of a film heating type.

The fixing apparatus 14 in the embodiment is an apparatus of a pressing roller driving type. According to the fixing apparatus 14, a guiding member (heating member supporting member) 20 which holds a heating member 90 is placed into pressure contact with a pressing roller (pressing member) 40 with a predetermined pressing force by a pressing stay 60 through a cylindrical fixing film (moving member) 30 having flexibility. Thus, a nip portion (pressure-contact nip portion, fixing nip portion) N is formed between the fixing film 30 and the pressing roller 40.

The film 30 is constructed by an endless single layer containing heat resistant PTFE, PFA, FEP, or the like as a main component in order to reduce a calorific capacity in consideration of realization of a high speed of the fixing process. A whole layer thickness is equal to or less than 100 μm, preferably, a value within a range from 40 μm or more to 80 μm or less. Or, the film 30 is constructed by a composite layer obtained by a method whereby an outer peripheral surface of an endless base material containing polyimide, polyamide, PEEK, PES, PPS, or the like as a main component has been coated with PTFE, PFA, FEP, or the like. A whole layer thickness is set to 100 μm or less, preferably, a value within a range from 40 μm or more to 80 μm or less.

The guiding member 20 is formed in a bucket shape having an almost semicircular cross section made of a high heat resistant resin material or the like such as PPS, liquid crystal polymer, or the like. The guiding member 20 has a function of supporting the heating member 90 and guiding the whole inner surface of the film 30 in the longitudinal direction.

The pressing roller 40 is formed by a method whereby an outer peripheral surface of a cylindrical or almost cylindrical core 40*a* containing iron, aluminum, or the like as a main component is coated with a cylindrical elastic layer 40*b* containing silicone rubber or the like having heat resistance and mold releasing performance as a main component. The pressing roller 40 is rotated in the arrow direction when a driving gear (not shown) provided in one end portion of the core 40*a* receives a rotational force from a fixing motor M.

Figure 3:
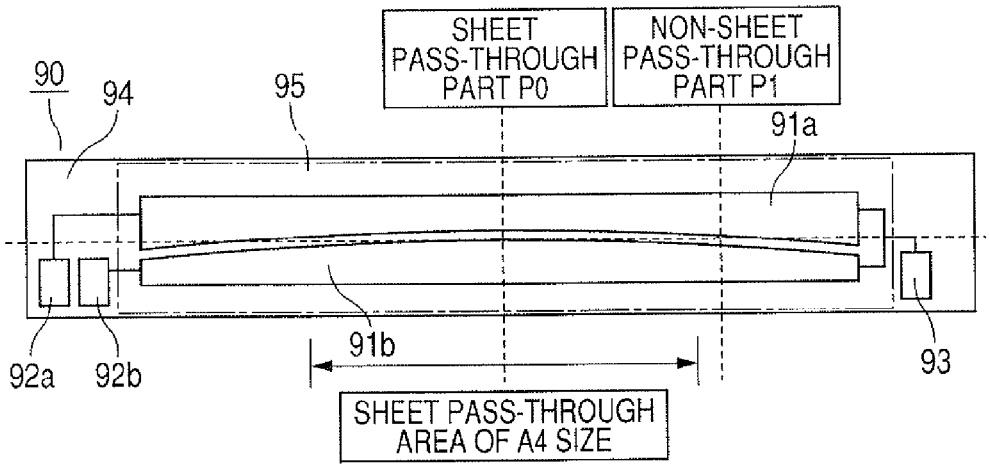
FIG. 3 is a schematic diagram of a schematic construction of a heating member.

FIG. 3 is a schematic diagram of a schematic construction of the heating member 90.

The heating member 90 has a thin plate-like substrate 94 containing ceramics represented by alumina or the like as a main component. The substrate 94 is an elongated member in which the direction which perpendicularly crosses the conveying direction of the sheet P is set to the longitudinal direction. One surface of the substrate 94 is coated with heat generating member patterns 91*a* and 91*b* containing Ag/Pd (silver/palladium) or the like as a main component, power feeding electrodes 92*a* and 92*b* containing Ag as a main component, and a common electrode 93 by screen printing or the like. The heat generating patterns (heat generating member) 91*a* and 91*b* are covered with an insulation protecting layer 95 containing glass, fluorine, or the like as a main component.

The heat generating pattern (first heat generating member) 91*a* is formed in such a manner that a resistance value per unit length is reduced by widening a width of the heat generating pattern step by step from a position near the center in the longitudinal direction toward edge portions and, in the case of electrifying, it has mountain-shaped heat generation distribution whose center in the longitudinal direction shows a heat generation peak. The heat generating pattern (dependent heat generating member, second heat generating member) 91*b* is connected so as to generate the heat in dependence on the heat generating pattern 91*a*. The heat generating pattern 91*b* is formed in such a manner that the resistance value per unit length is increased by narrowing a width of the heat generating pattern from the center in the longitudinal direction toward edge portions and, in the case of electrifying, it has valley-shaped heat generation distribution whose center in the longitudinal direction shows a heat generation bottom.

As for the heating member 90, the side where the insulation protecting layer 95 has been provided is the front surface side. The inner surface of the film 30 slides on the surface of the insulation protecting layer 95. The heating member 90 is fitted into a groove formed on the bottom surface of the guiding member 20 along the longitudinal direction so that the surface side of the heating member 90 faces the outside. The heating member 90 is adhered with a heat resistant adhesive agent and held. A thermistor (temperature detecting means) 50 is arranged onto the back surface of the substrate 94 of the heating member 90 so as to be come into contact with the back surface or is arranged near the back surface.

Figure 4:
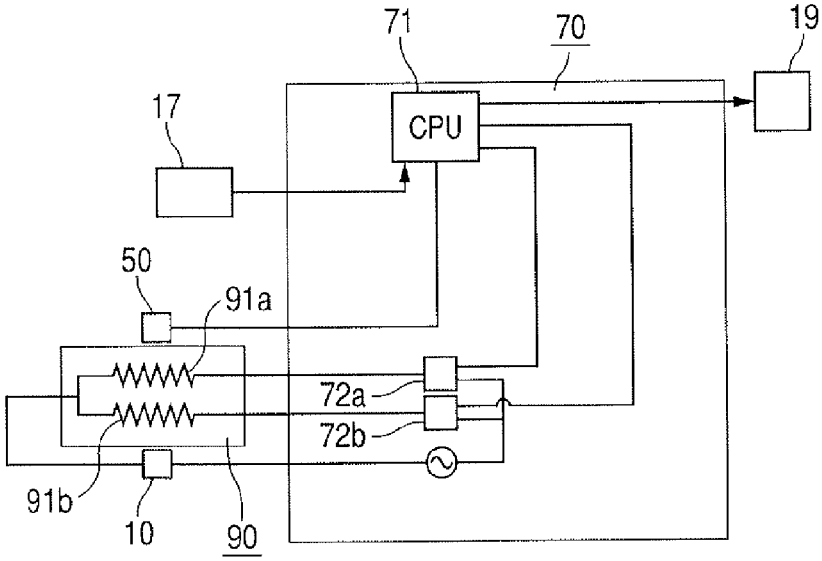
FIG. 4 is a circuit diagram of an example of a heating member drive control part.

FIG. 4 is a circuit diagram of an example of a heating member drive control part 70.

In the heating member drive control part 70 for controlling the electrification of the heating member 90, a CPU (control means) 71 receives an output signal (detection temperature signal) of the thermistor 50. The CPU 71 uses what is called phase control or wave number control in which a turn-on time of each of TRIACs 72*a* and 72*b* is drive-controlled for an AC power source waveform on the basis of the output signal so that a temperature of the thermistor 50 reaches a predetermined target fixing temperature (190 to 210° C.). The CPU 71 can decide a turn-on duty of the TRIAC 72*a* and a turn-on time ratio of the TRIAC 72*b* to the turn-on duty and can make the foregoing temperature control with desired heat generation distribution (temperature distribution) of the heating member device in the longitudinal direction.

In the heating member drive control part 70, a safe element 100 (temperature fuse, thermo-switch, or the like) to prevent the over-temperature rising at the heating member 90 is serially connected onto an electrifying line. In the embodiment, the safe element 100 is arranged so as to come into contact with the heating member 90 or be near it.

In the fixing apparatus 14 of the embodiment, as shown in FIG. 2, when the pressing roller 40 is rotated in the arrow direction, a rotational force acts on the film 30 by a sliding frictional force with the surface of the film 30 that is caused by the rotation of the pressing roller 40, so that the film 30 rotates in the arrow direction around the outer periphery of the guiding member 20. The CPU 71 drive-controls the turn-on time of each of the TRIACs 72*a* and 72*b* on the basis of detection temperature information of the thermistor 50, so that a temperature of the heating member 90 is adjusted to the predetermined target fixing temperature. In this state, by conveying the sheet P on which a non-fixed toner image t has been held while sandwiching it in the nip portion N, the heat of the heating member 90 is transferred onto the sheet P through the film 30 and the non-fixed toner image t is thermally fixed onto the surface of the sheet P. The sheet P which has passed through the nip portion N is curvature-separated from the surface of the film 30 and ejected.

(III) Conventional Countermeasure for Suppressing Temperature Rising of Non-Sheet Pass-Through Part A countermeasure for suppressing the temperature rising at the non-sheet pass-through part in the conventional image forming apparatus will now be described.

Hitherto, the following countermeasure according to feeding control of the image forming apparatus or countermeasure according to a construction of the heating member and a heating control method has been used.

Related Art (1): Feeding Control of Image Forming Apparatus

The temperature rising at the non-sheet pass-through part appears remarkably upon continuous passage of the sheets of the narrow width size as mentioned above. Therefore, by widening a distance between the sheets (hereinafter, referred to as a feeding interval) upon continuous sheet passage and decreasing a throughput (the number of sheets which are conveyed per unit time), a degree of progress of the temperature rising at the non-sheet pass-through part per sheet is decreased and the occurrence of the sheet wrinkles can be suppressed.

Figure 7:
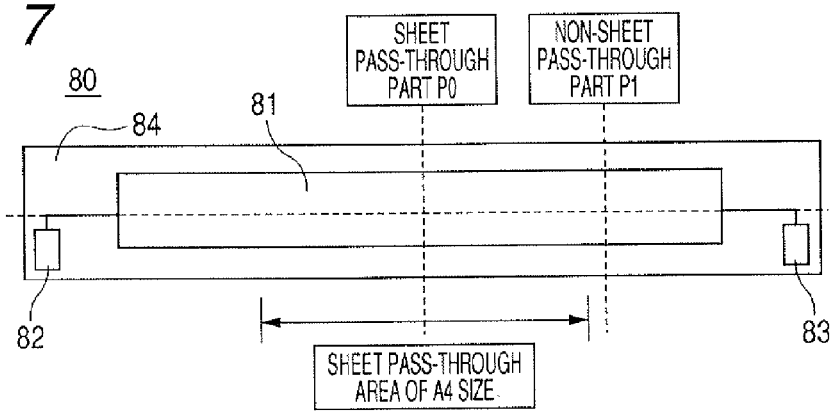
FIG. 7 is a schematic diagram of a schematic construction of a heating member in a related art (1).

For example, in an image forming apparatus having a fixing apparatus with a heating member 80 (refer to FIG. 7) which holds flat heat generation distribution in the longitudinal direction, the inventors examined a tendency of the occurrence of the sheet wrinkles of the JOB of the continuous sheet passage of the A4 size in the longitudinal direction in an environment of 32° C./80% RH. Specifications of this apparatus are as follows: the maximum sheet passage width is equal to the width of the lateral pass-through sheet of the A4 size; the conveying speed is equal to 150 mm/sec; and the feeding interval upon lateral sheet passage of the A4 size is equal to 30 sheets/minute (ppm). Thus, it has been found that the occurrence of the sheet wrinkles can be prevented by extending the feeding interval to 4 ppm. In the heating member 80, reference numeral 81 denotes a heat generating member pattern formed on one surface of a thin plate-like substrate 84 containing ceramics as a main component and 82 and 83 indicate power feeding electrodes each containing Ag as a main component. An insulation protecting layer is omitted in the diagram.

Figure 8:
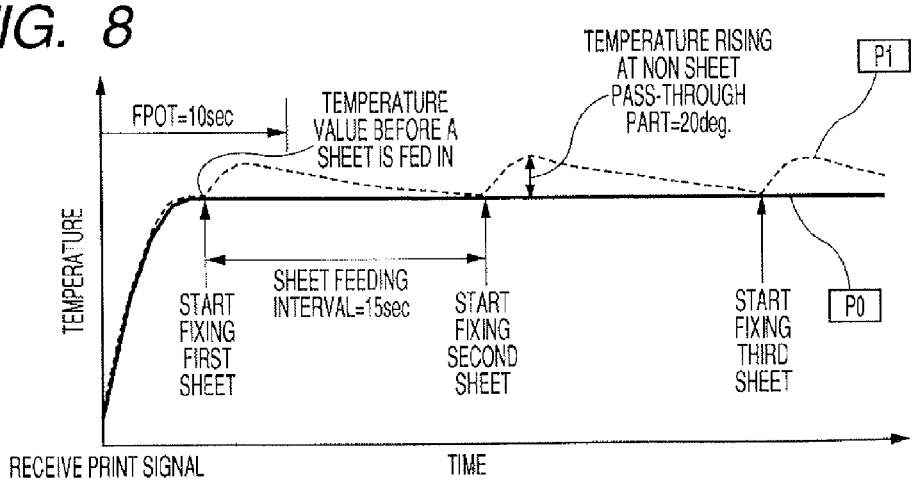
FIG. 8 is a diagram showing a temperature shift in the JOB of each of the sheet pass-through part and the non-sheet pass-through part in the related art (1).

A temperature shift in the JOB of each of the sheet pass-through part (temperature control part) P0 and the non-sheet pass-through part (area which is outside by 10 mm from each of the right and left edges of the sheet) P1 of the heating member 80 is shown in FIG. 8.

In FIG. 8, a time (first print-out time, hereinafter, abbreviated to FPOT) until the ejection of the first sheet is completed after the reception of a print signal is equal to 10 sec. A temperature difference between the sheet pass-through part P0 and the non-sheet pass-through part P1 just before the first sheet reaches the fixing apparatus (that is, temperature difference before the sheet is fed in) is equal to almost 0 deg. Each time one sheet of the A4 size in the longitudinal direction passes through the fixing apparatus, a temperature rise at the non-sheet pass-through part of about 20 deg. occurs. It will be understood that the temperature difference in the longitudinal direction is almost eased for a period of time of the feeding interval (15 seconds in the case of 4 ppm) between the first sheet and the material to be heated which will subsequently arrive and, during the continuous sheet passage of 4 ppm, the temperature of the non-sheet pass-through part is not extremely higher than that of the sheet pass-through part.

Related Art (2): Construction of Heating Member and Heating Control Method

For example, a method whereby the heating member 90 with the same construction as that of the embodiment is drive-controlled by the heating member drive control part 70 with the same construction as that of the embodiment, thereby reducing the temperature rising at the non-sheet pass-through part upon continuous passage of the sheets of the narrow width size, has been proposed in Japanese Patent Application Laid-Open No. H10-177319.

According to such a method, in the heating member drive control part 70, the CPU 71 determines the turn-on time ratio of the TRIACs 72*a* and 72*b* and drive-controls the TRIACs 72*a* and 72*b*, thereby providing a smooth gradation for the heat generation distribution in the longitudinal direction of the heating member 90.

Figure 9:
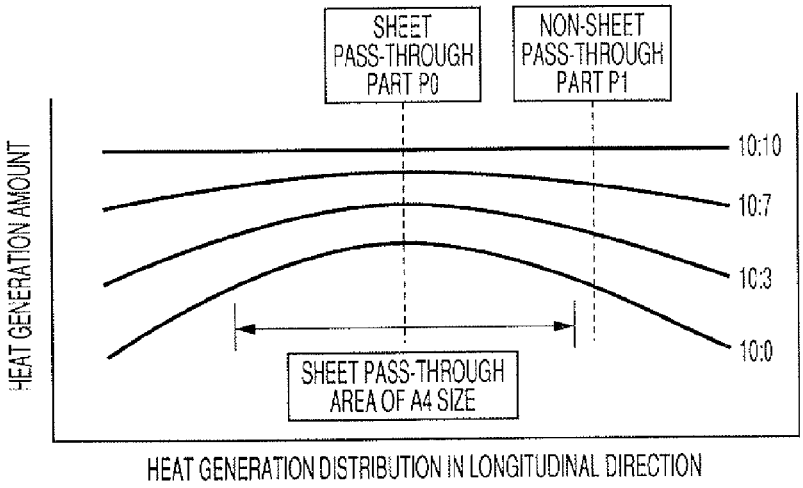
FIG. 9 is a diagram showing an example of heat generation distribution in the longitudinal direction of the heating member according to a turn-on ratio of TRIACs in each of the fixing apparatus in the image forming apparatus according to the invention and a fixing apparatus in an image forming apparatus in a related art (2).

An example of heat generation distribution in the longitudinal direction of the heating member 90 according to the turn-on time ratio of the TRIACs 72*a* and 72*b* is shown in FIG. 9. In the case of using the fixing apparatus which has the heating member 90 and in which the sheet pass-through reference is set to the center reference, for example, one of 10:10, 10:7, 10:3, and 10:0 is selected as a turn-on time ratio of the TRIACs 72*a* and 72*b* in accordance with the length of sheet in the longitudinal direction. Thus, the temperature rising at the non-sheet pass-through part can be suppressed within a predetermined range while assuring fixing performance. The feeding interval shorter than that in the case of using the heating member 80 in FIG. 7 can be permitted in the passage of the sheets of the narrow width size.

However, even in the image forming apparatus having the fixing apparatus like a related art (2), there is also such a problem that the throughput has to be suppressed to a fairly low value in order to prevent the wrinkles of the sheets of the narrow width size in the high-temperature and high-moisture environment and the FPOT is extremely delayed.

In the image forming apparatus in the related art (2), the inventors examined the tendency of the occurrence of the sheet wrinkles of the JOB of the continuous sheet passage of the A4 size in the longitudinal direction in the environment of 32° C./80% RH. Specifications of this apparatus are as follows: the maximum sheet passage width is equal to the width of the lateral pass-through sheet of the A4 size; the conveying speed is equal to 150 mm/sec; and the feeding interval upon lateral sheet passage of the A4 size is equal to 30 ppm. Thus, it has been found that the occurrence of the sheet wrinkles can be prevented by extending the feeding interval to 6 ppm. The turn-on time ratio of the TRIACs 72*a* and 72*b* in the print JOB is set to 10:0, that is, the heat generation distribution is set to the maximum mountain-shaped heat generation distribution as much as possible in which only the heat generating pattern 91*a* of the heating member 90 generates the heat.

Figure 10:
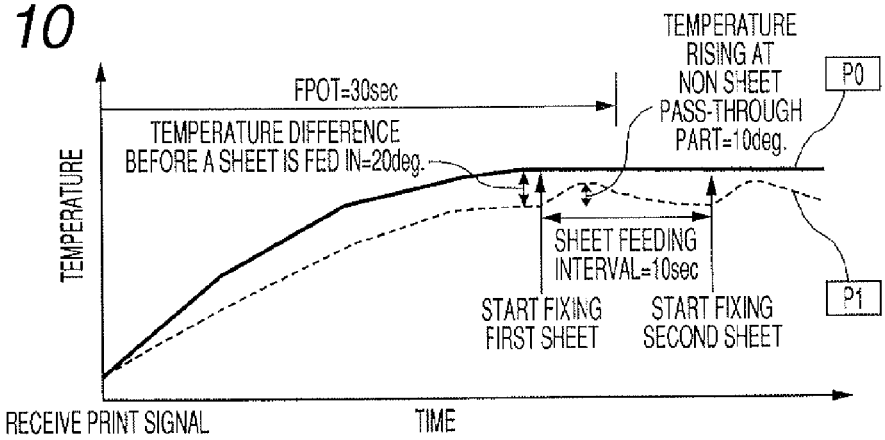
FIG. 10 is a diagram showing a temperature shift in the JOB of each of a sheet pass-through part and a non-sheet pass-through part of the fixing apparatus in the image forming apparatus in the related art (2).

A temperature shift in the JOB of each of the sheet pass-through part (temperature control part) P0 and the non-sheet pass-through part (area which is outside by 10 mm from each of the right and left edges of the material to be heated) P1 of the heating member 90 is shown in FIG. 10. As shown in FIG. 10, the FPOT after the reception of the print signal is equal to 30 sec and the temperature difference between the sheet pass-through part P0 and the non-sheet pass-through part P1 just before the first sheet reaches the fixing apparatus (that is, temperature difference before the sheet is fed in) is equal to 20° C. (the temperature of P1 is lower than that of P0). Each time one sheet of the A4 size in the longitudinal direction passes through the fixing apparatus, the temperature rising at the non-sheet pass-through part of about 10° C. occurs. It will be understood that the temperature of the non-sheet pass-through part is not extremely higher than that of the sheet pass-through part during the continuous sheet passage of 6 ppm.

However, with respect to the feeding interval, since it is equal to 15 sec in the related art (1) and to 10 sec in the related art (2), the performance of the related art (2) is higher than that of the related art (1). However, when considering the fact that the FPOT in the related art (2) is extremely delayed from that in the related art (1), for example, the number of sheets which are ejected one minute after the reception of the print signal is equal to 4 in both of the related arts (1) and (2). Therefore, the performance of the substantial throughput of the related art (2) is not higher than that of the related art (1).

Figure 5:
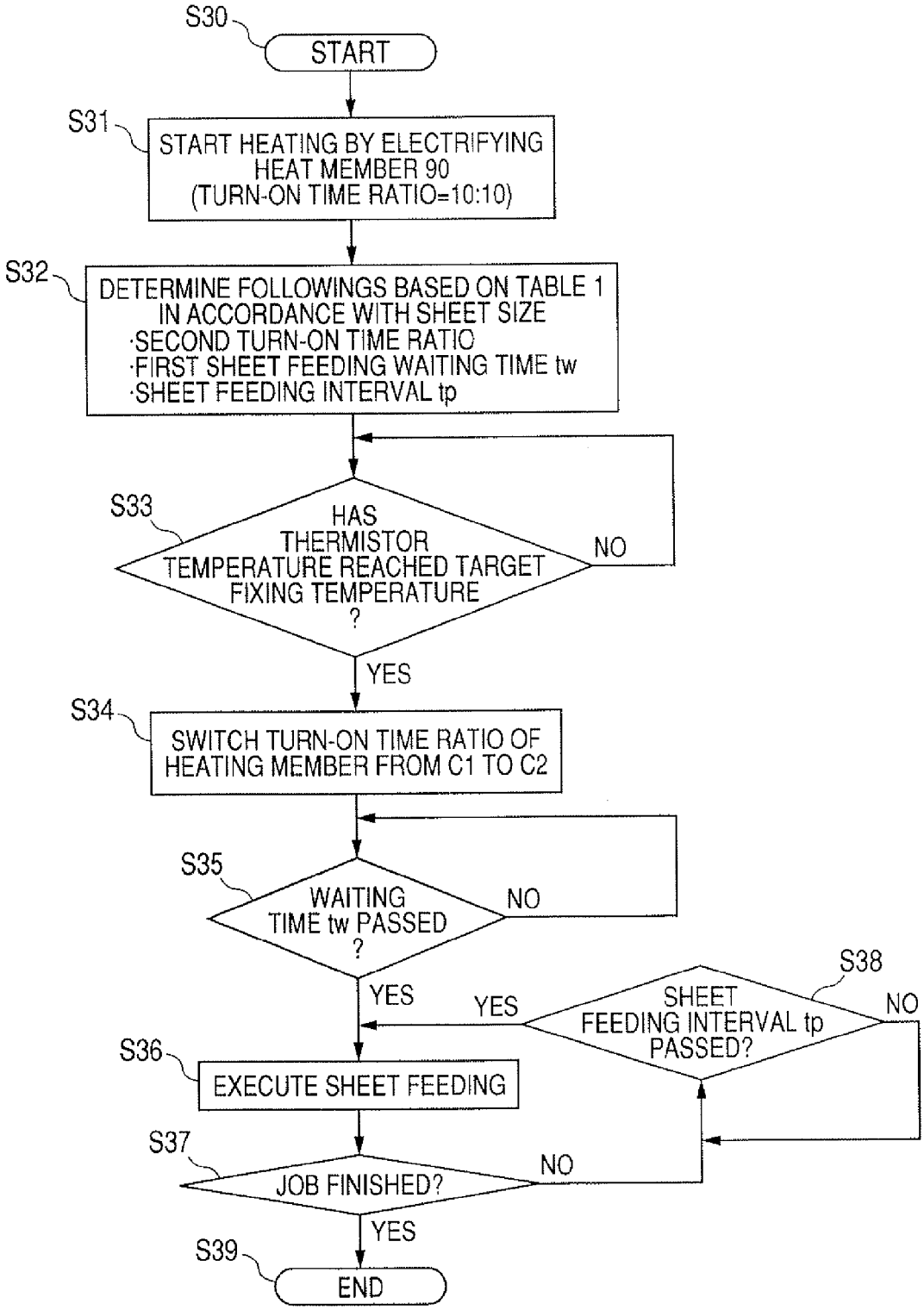
FIG. 5 is a flowchart for heating and feeding control in the case of continuously forming images onto a sheet.

(4) Countermeasure for Suppressing Temperature Rising of Non-Sheet Pass-Through Part and Countermeasure for Improving Throughput A flowchart for heating and feeding control by the CPU 71 in the case of continuously performing the image creation (print JOB) onto the sheet P is shown in FIG. 5.

First, when a print command is inputted to the image forming apparatus, the heating to electrify the heating member 90 is started synchronously with the driving of the fixing motor M of the fixing apparatus 14 (step S31). At this time, it is desirable that a heat generation ratio of the heat generating patterns 91*a* and 91*b*, that is, a first turn-on time ratio C1 of the TRIACs 72*a* and 72*b*, is assumed to be 10:10 (constant) irrespective of the sheet size and the permissible maximum electric power to be applied. Such a process is control for preferentially allowing the temperature of the heating member 90 to reach the target fixing temperature (in a short time) while suppressing a heat storage amount to the whole fixing apparatus 14 as much as possible, and has such an advantage that the maximum effect of an edge portion heat radiating effect after the switching of the turn-on time ratio, which will be explained hereinafter, can be obtained. In addition, there is also such an advantage that the feeding can be started without extending the FPOT unnecessarily.

Subsequently, the CPU 71 receives a sheet size signal from the sheet size detecting mechanism 17 and decides a second turn-on time ratio C2, a first-sheet feeding waiting time tw, and a feeding interval tp according to the sheet size corresponding to the sheet size signal (S32).

Set values in the embodiment conform with those shown in TABLE 1. The set values shown in TABLE 1 are the set values obtained in the case where a quality problem including the wrinkles in the high-temperature and high-moisture environment did not occur when the inventors have preliminarily examined by making the control of the embodiment in the image forming apparatus having the heating member 90. As shown in TABLE 1, the second turn-on time ratio C2 is decided in accordance with the sheet size. The second turn-on time ratio C2 is equal to or less than the first turn-on time ratio C1.

TABLE 1

| Size Name | Width in the longitudinal direction | Second turn-on time ratio C2 heating member 91a:heating member 91b | First-sheet waiting time | Feeding interval tp |
|---|---|---|---|---|
| A3 longitudinal | 297 mm | 10:10 | 0 sec | 4 sec |
| A4 lateral | | | | 2 sec |
| LETTER longitudinal | 279.4 mm | 10:7 | | 4 sec |
| LETTER lateral | | | | 2 sec |
| B4 longitudinal | 258 mm | 10:3 | 3 sec | 6 sec |
| B5 lateral | | | | 3 sec |
| LETTER longitudinal | 215.9 mm | 10:0 | 5 sec | 6 sec |
| A4 longitudinal | 210 mm | | | 6 sec |
| LEGAL longitudinal | 215.9 mm | | | 7.5 sec |

Subsequently, the temperature of the thermistor 50 provided for the heating member 90 is monitored and the heating according to the first turn-on time ratio C1 is continued until it reaches the target fixing temperature (S33). In S33, when the temperature of the thermistor 50 reaches the target fixing temperature, the turn-on time ratio is switched to the second turn-on time ratio C2 (S34). In the fixing apparatus 14 in the embodiment, it reaches the target fixing temperature in a time of about 3 to 5 seconds.

Subsequently, the timing when the turn-on time ratio is switched to the second turn-on time ratio C2 is used as a base point and after the elapse of the first-sheet feeding waiting time tw decided in S32 from such a base point, a motor of the feeding mechanism 19 is rotated, thereby feeding the first sheet P from the cassette (S35, S36). Particularly, in the sheets of the narrow width size, such waiting control provides an action to sufficiently reduce the temperature of the non-sheet pass-through part (to about a temperature which does not exert an influence on the fixing performance of the sheet pass-through part) at the stage before the first sheet reaches the fixing apparatus 14. Such an action is more remarkably effective in the state where the heat storage amount of the whole fixing apparatus 14 is small, that is, in the state where the whole fixing apparatus 14 is cool. In the case of the embodiment, by making such control to the sheets of the A4 size in the longitudinal direction, the temperature of the heating member 90 in the non-sheet pass-through part (area which is outside by 10 mm from each of the right and left edges of the sheet) P1 is lower than that of the sheet pass-through part (temperature control part) P0 by 35° C. just before the first sheet is fed into the fixing apparatus 14 (refer to the temperature difference before the sheet is fed in FIG. 6).

In the case of the continuous feeding after the first sheet was fed, the sheet feeding is continued with the feeding interval tp decided in S32 while monitoring the time by the top sensor 12 (S37, S38) and the JOB is finished (S39).

Figure 6:
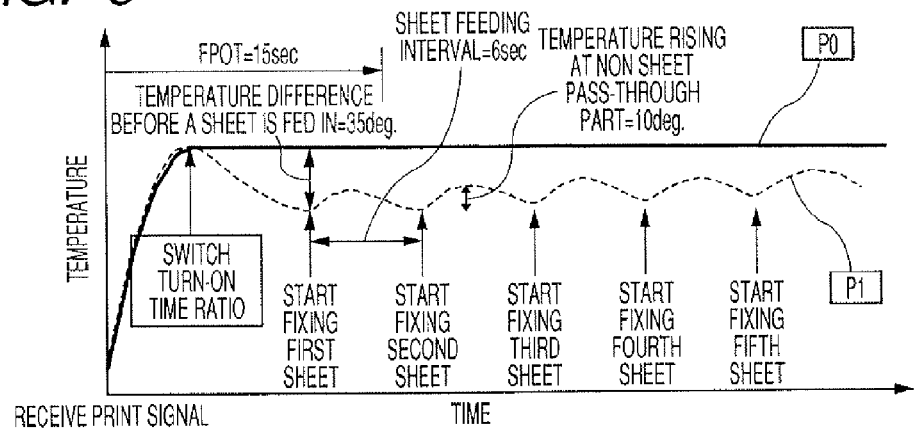
FIG. 6 is a diagram showing a temperature shift of each of a sheet pass-through part and a non-sheet pass-through part at the time when a JOB of a continuous sheet passage of the A4 size in the longitudinal direction has been executed.

In the image forming apparatus of the embodiment, a temperature shift at the foregoing positions of P0 and P1 at the time when the JOB of the continuous sheet passage of the A4 size in the longitudinal direction has been executed in accordance with the above flowchart is shown in FIG. 6.

In FIG. 6, the temperature difference between the sheet pass-through part P0 and the non-sheet pass-through part P1 just before the first sheet reaches the fixing apparatus 14 (temperature difference before the sheet is fed in) is equal to 35° C. (the temperature of P1 is lower than that of P0) and the FPOT after the reception of the print signal is equal to 15 sec and is relatively shorter than the conventional one. Each time one sheet of the A4 size in the longitudinal direction passes through the fixing apparatus 14, a temperature rise at the non-sheet pass-through part of about 10 deg. occurs. It will be understood that the temperature of the non-sheet pass-through part is not extremely higher than that of the sheet pass-through part during the continuous sheet passage of 10 ppm.

TABLE 2 shows comparison results of wrinkle-proof performance upon sheet passage of the A4 size in the longitudinal direction when the feeding interval is changed in the embodiment and the foregoing relates arts (1) and (2). The pass-through environment is set to 32° C./80% RH, a sheet type is set to a type of thin paper whose basis weight is equal to 64 g/m$^2$, 100 thin sheets are allowed to continuously pass through, and a paper wrinkle occurrence rate (%) is shown.

TABLE 2

| Throughput | Example 1 | Related art (1) | Related art (2) |
|---|---|---|---|
| 20 ppm | 20% | 50% | 30% |
| 12 ppm | 5% | 30% | 15% |
| 10 ppm | 0% | 25% | 10% |
| 8 ppm | 0% | 15% | 5% |
| 6 ppm | 0% | 5% | 0% |
| 5 ppm | 0% | 2% | 0% |
| 4 ppm | 0% | 0% | 0% |

According to TABLE 2, it will be understood that the paper wrinkle suppressing effect in the JOB of the continuous sheet passage of the narrow width size in the embodiment (Example 1) is higher than that in the related arts (1) and (2). According to the embodiment, for example, as for the number of sheets which are ejected after the elapse of one minute from the reception of the print signal, eight sheets can be outputted while four sheets can be outputted in the related arts, so that the substantial throughput can be remarkably improved.

In the image forming apparatus of the embodiment, with respect to the temperature leading of the heating member 90 before the sheet P reaches the fixing apparatus 14, the heating member 90 is heated at the first turn-on time ratio C1. Thus, the temperature of the sheet pass-through part of the heating member 90 can be allowed to reach the target fixing temperature in a time shorter than that in the related art while minimizing the heat storage amount to the whole fixing apparatus 14. Since the heat storage amount is minimum, an amount of drop of the temperature of the non-sheet pass-through part of the heating member 90 which is caused by the switching to the second turn-on time ratio C2 can be increased by an amount larger than that in the related art. Therefore, the temperature rising at the non-sheet pass-through part can be reduced by an amount larger than the conventional one even during the continuous sheet passage of the sheet P. The substantial throughput to prevent the paper wrinkles caused by the temperature rising at the non-sheet pass-through part of the sheets P of the narrow width size also in the high-temperature and high-moisture environment can be remarkably improved more than the conventional one.

In the embodiment, since the highest operational effect can be obtained by switching the turn-on time ratio or deciding the waiting time and feeding interval by detecting the sheet size or by inputting the information before the sheet feeding, the example limited to such a method has been described above. However, the detection of the sheet size, the switching of the turn-on time ratio, and the decision of the waiting time and the feeding interval are not limited to such an example. For instance, a similar effect can be also obtained by making control in which the sheet size is detected or the turn-on time ratio and the feeding interval are determined before the sheet reaches the fixing apparatus 14 during the conveyance of the first sheet of the print JOB.

Although the sheet size is discriminated on the basis of the output signal of the sheet size detecting mechanism 17, the discriminating method of the sheet size is not limited to such an example but the sheet size can be also discriminated on the basis of input information of the size which is inputted by an operation panel or size information which is inputted from a formatter.

Embodiment 2

Another example of an image forming apparatus according to the invention will now be described.

In the embodiment 2, component elements and portions common to those in the image forming apparatus of the embodiment 1 are designated by the same reference numerals and an overlapped explanation of them is omitted here.

According to the image forming apparatus of the embodiment 2, in the fixing apparatus 14, the main thermistor (first temperature detecting element) 50 to make the temperature control during the image creation and a sub-thermistor (another temperature detecting element) 51 to monitor the temperature of the non-sheet pass-through part are provided. For an output of the main thermistor 50, feeding timing of the sheet P is determined on the basis of a drop amount of the temperature of the sub-thermistor 51.

Figure 11:
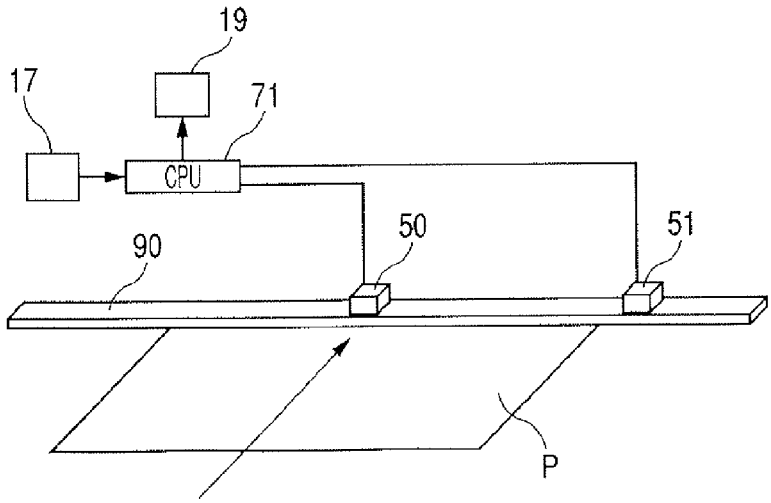
FIG. 11 is a diagram showing an example of a layout of a main thermistor and a sub-thermistor in a fixing apparatus of an image forming apparatus according to an embodiment 2.

An example of a layout of the main thermistor 50 and the sub-thermistor 51 used in the fixing apparatus 14 of the embodiment is shown in FIG. 11.

The main thermistor 50 is a temperature detecting element arranged at a position which always becomes the sheet pass-through part even if the sheet P of any size has been allowed to pass through. The sub-thermistor 51 is a temperature detecting element arranged at a position (which is away from a center conveyance reference position by 132 mm) which becomes the non-sheet pass-through part when the sheet whose width is smaller than that of the pass-through sheet of the LETTER size in the lateral direction has been allowed to pass through. The sub-thermistor 51 is not used in the temperature control but detects only the temperature rising at the edge portion of the heating member 90 such as temperature rising at the non-sheet pass-through part. An output signal of the sub-thermistor 51 is also inputted to the CPU 71 in a manner similar to the output signal of the main thermistor 50. The CPU 71 receives the output signal of the sub-thermistor 51 in a real-time manner and monitors the temperature rising at the edge portion of the heating member 90.

Figure 12:
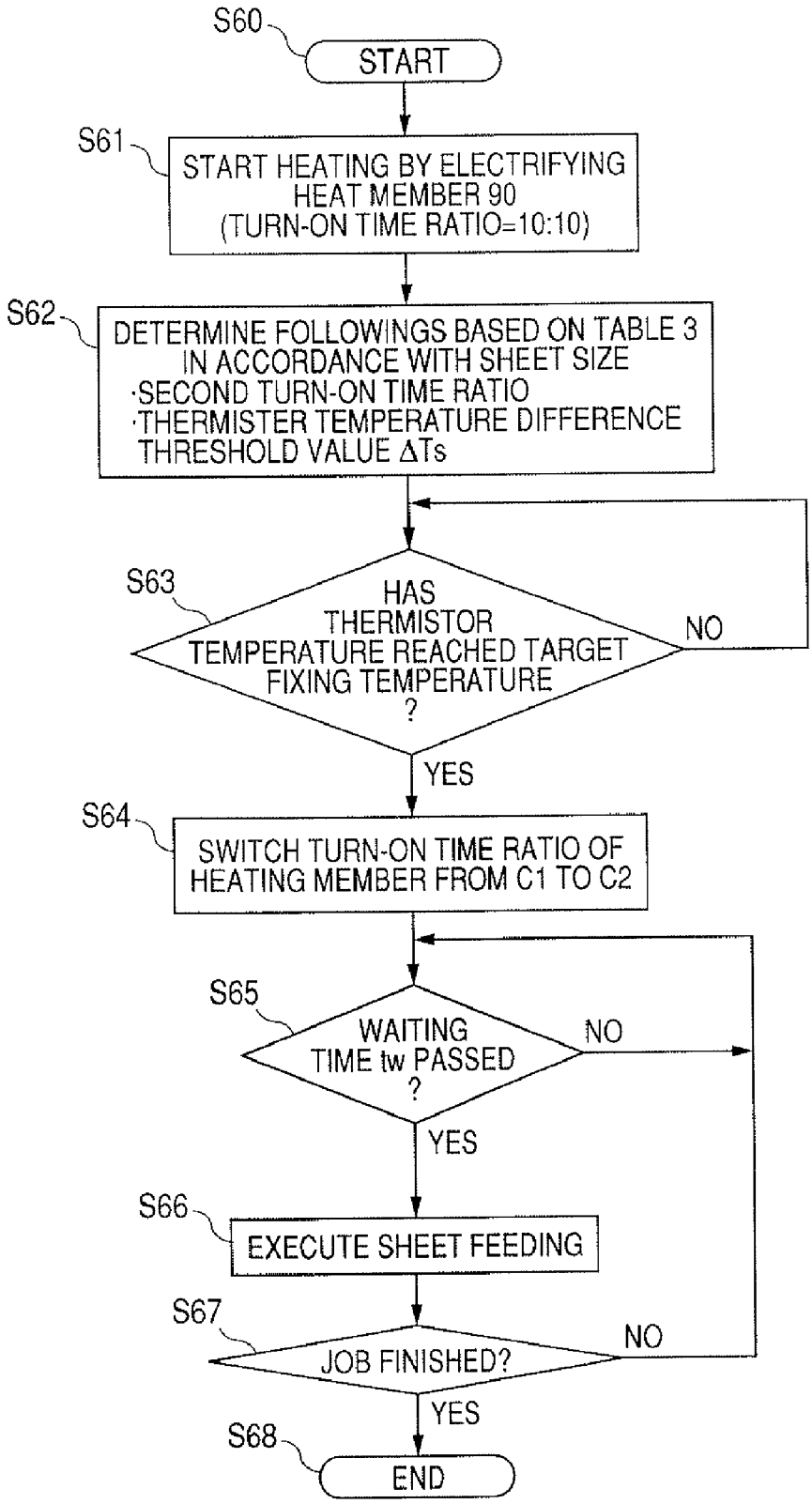
FIG. 12 is a flowchart for heating and feeding control in the case of continuously forming images onto a sheet.

The heating and feeding control method by the CPU 71 will now be described with reference to a flowchart of FIG. 12.

Step S61 is similar to S31 (FIG. 5) in the embodiment 1.

In S62, the sheet size signal is fetched from the sheet size detecting mechanism 17, and the second turn-on time ratio C2 according to the sheet size corresponding to the sheet size signal and a thermistor temperature difference threshold value ΔTs (which is controlled by the peculiar feeding interval tp in the case where the LETTER size in the lateral direction is equal to 279.4 mm or more) are decided according to the sheet size.

Set values in the embodiment conform with those shown in TABLE 3. Among the set values shown in TABLE 3, ΔTs is the set value calculated from the right and left edge positions of each sheet size, the layout position of the sub-thermistor 51, and the heat generation distribution in the longitudinal direction according to the heat generation ratio of the heat generating patterns 91*a* and 91*b*. This value is the set value by which the temperature of the non-sheet pass-through part near a sheet shingle can be within a predetermined range irrespective of the size of sheet P.

TABLE 3

| Size Name | Width in the longitudinal direction | Second turn-on time ratio C2 heating member 91a:heating member 91b | Thermistor temperature difference (main-sub) threshold value ΔTs | Feeding interval tp |
|---|---|---|---|---|
| A3 longitudinal | 297 mm | 10:10 | — | 4 sec |
| A4 lateral | | | | 2 sec |
| LETTER longitudinal | 279.4 mm | 10:7 | | 4 sec |
| LETTER lateral | | | | 2 sec |
| B4 longitudinal | 258 mm | 10:3 | 18 deg | — |
| B5 lateral | | | | — |
| LETTER longitudinal | 215.9 mm | 10:0 | 25 deg | — |
| A4 longitudinal | 210 mm | | | — |
| LEGAL longitudinal | 215.9 mm | | | — |

Processes in steps S63 and S64 are the same as those in steps S33 and S34 in the embodiment 1.

The embodiment 2 differs from the embodiment 1 with respect to a point that in S65 and S66, the degree by which the output temperature of the sub-thermistor 51 is lower than that of the main thermistor 50 is monitored and the sheet feeding control is made at a point of time when the degree exceeds the threshold value ΔTs. In the embodiment 1, the sheet feeding control is made at the predetermined waiting time and the feeding interval in S35 and S36. In the case of the embodiment 2, a sheet feeding permission is given at a point of time when the temperature of the portion which is outside by 10 mm from each of the right and left edges of the sheet P is estimated to be lower than that of the main thermistor 50 by about 15 deg. By this method, particularly, the FPOT and the feeding interval at the initial stage of the JOB can be set to a shorter time.

By making the control as in the embodiment 2, while the temperature difference between the sheet pass-through part and the non-sheet pass-through part is accurately managed in accordance with each sheet size, the substantial throughput can be further improved in a range where no paper wrinkles are caused in the high-temperature and high-moisture environment.

Embodiment 3

Another example of the image forming apparatus according to the invention will now be described.

The image forming apparatus according to the embodiment 3 is characterized by a point that the heating and feeding control made in the embodiments 1 and 2 is converted into a specific mode and a mode of giving a priority to the FPOT and the throughput is separately set.

Also in the embodiment 3, component elements and portions common to those in the image forming apparatuses of the embodiments 1 and 2 are designated by the same reference numerals and an overlapped explanation of them is omitted here.

The control example which intends to avoid the occurrence of the paper wrinkles in the high-temperature and high-moisture environment by suppressing the temperature of the non-sheet pass-through part in the JOB of the continuous sheet passage of the narrow width size as much as possible has been described in the embodiments 1 and 2. However, inherently, in the case of the sheets other than the thin paper whose basis weight is equal to or less than 75 g/m$^2$, there is a little fear of occurrence of the wrinkles. Unless the environment is the high-temperature and high-moisture environment, there is also a little fear of occurrence of the wrinkles. Therefore, there is a case where the control shown in the embodiments 1 and 2 is unnecessary in dependence on a use situation of the user. In such a case, since the temperature rising at the non-sheet pass-through part can be permitted to a certain extent, the earlier FPOT and the better throughput can be provided.

In the image forming apparatus and the fixing apparatus 14 in each of the embodiments 1 and 2, the fixing control temperature of the heating member 90 has been set to a value within a range of 190 to 210° C. However, it has been known that if the temperature of the heating member 90 is equal to or less than 250° C., the problem such as a heat loss or the like of the apparatus does not occur.

In the image forming apparatus of the embodiment 3, the fixing apparatus 14 in the embodiment 2 is mounted as a fixing apparatus 14. The CPU 71 has a "throughput priority mode (first mode)" in which temperatures of up to the temperature of the non-sheet pass-through part of 250° C. are permitted and a "wrinkle avoiding mode (second mode)" corresponding to the throughput for prevention of the wrinkles described in the embodiments 1 and 2 and can selectively use either the first or second mode in accordance with circumstances.

Initial throughputs in each sheet size in the "throughput priority mode" and the "wrinkle avoiding mode" conform with those shown in TABLE 4.

TABLE 4

| Size Name | Width in the longitudinal direction | Initial throughput of "throughput priority mode" (ppm) | Initial throughput of "wrinkle avoiding mode (Example 1) |
|---|---|---|---|
| A3 longitudinal | 297 mm | 15 ppm | 15 ppm |
| A4 lateral | | 30 ppm | 30 ppm |
| LETTER longitudinal | 279.4 mm | 15 ppm | 15 ppm |
| LETTER lateral | | 30 ppm | 30 ppm |
| B4 longitudinal | 258 mm | 18 ppm | 10 ppm |
| B5 lateral | | 24 ppm | 20 ppm |
| LETTER longitudinal | 215.9 mm | 20 ppm | 10 ppm |
| A4 longitudinal | 210 mm | 20 ppm | 10 ppm |
| LEGAL longitudinal | 215.9 mm | 18 ppm | 8 ppm |

In the image forming apparatus of the embodiment 3, for example, the initial throughput in the JOB of the continuous sheet passage of the A4 size in the longitudinal direction is set to 20 ppm and the temperature of the non-sheet pass-through part is detected by the sub-thermistor 51 (FIG. 11) during the JOB. When the temperature of the non-sheet pass-through part exceeds 250° C. (restriction temperature), the CPU 71 executes the throughput priority mode and controls the rotation of the motor of the feeding mechanism 19 so as to extend the feeding interval by a predetermined time (for example, every two seconds). In this manner, the temperature rising at the non-sheet pass-through part is set to be, that is, restricted within 250° C. The CPU 71 executes the wrinkle avoiding mode so that no wrinkles occur in the sheet P when the temperature of the non-sheet pass-through part is lower than 250° C., and controls the rotation of the motor of the feeding mechanism 19 so as to extend the feeding interval by the predetermined time.

By making such sheet feeding control, the throughput which is extremely better than those in the embodiments 1 and 2 can be obtained particularly with respect to the narrow width size. The throughput performance can be further improved by allocating a proper turn-on time ratio to the heat generating patterns 91*a* and 91*b* within a proper range during the JOB by using the heating member 90 which can control the heat generation distribution in the longitudinal direction. Further, in this mode, since the sheet feeding waiting time for delaying the FPOT is not provided, the FPOT can be made earlier.

As a method of switching the "throughput priority mode" and the "wrinkle avoiding mode", for example, it is also possible to use a method whereby the throughput priority mode is set to be default and the user can select the wrinkle avoiding mode. In this case, the above mode switching is performed by the operation panel (selecting means). As another switching method, it is also possible to use a method whereby temperature and moisture sensors, a media type discriminating sensor, a media moisture absorption amount detecting sensor, and the like are provided in the image forming apparatus and, when a possibility of occurrence of the wrinkles occurs, the mode is automatically shifted to the wrinkle avoiding mode by the CPU 71. In such a case, the CPU 71 functions as selecting means.

According to the embodiment 3, since it is possible to meet the requirement of the user to give the priority to the FPOT and the throughput and the desired mode can be selected in accordance with the use environment or request of the user, the quality and reliability of the image forming apparatus can be further improved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-018964, filed Jan. 27, 2006, which is hereby incorporated by reference herein in its entirety.

What is claimed is:

1. An image forming apparatus comprising:

a heating device, including:

a heating member having a first heat generating member having a heat generation peak at a center portion in a longitudinal direction of said heating member, and a second heat generating member having heat generation peaks at both end portions in the longitudinal direction, said first and second generating members independently generating heat on an elongated substrate, first and second temperature detecting means which detect a temperature of said heating member, wherein said first temperature detecting means is arranged at a position which always becomes a material pass-through part regardless of the size of the material, and said second temperature detecting means is arranged at a position which becomes a non-sheet pass-through part when a sheet material whose size is smaller than a predetermined size has been allowed to pass through, a moving member which moves in contact with said heating member, and a pressing member which forms a nip portion together with said heating member through said moving member and thereby heats an image on a material to be heated while sandwiching and conveying the material to be heated by the nip portion;

a heating member drive control part for controlling electrical power supplied to said first and second heat generating members in accordance with a temperature detected by said first temperature detecting means; and a feeding device which feeds the material to be heated to said heating device, wherein in a case where a print signal for an image on a first sheet material is input in a condition where said moving member and said pressing member are stopped, said moving member and said pressing member start rotating, and said heating member drive control part starts controlling electrification to said first and second heat generating members so that a turn-on time ratio between said first heat generating member and said second heat generating member becomes a first turn-on time ratio defined irrespectively of a size of the material to be heated, wherein in a condition under electrification in the first turn-on time ratio when the temperature detected by said first temperature detecting means reaches a predetermined target temperature, said heating member drive control part switches the turn-on time ratio to a second turn-on time ratio that is defined according to a size of the material to be heated, that is equal to or less than the first turn-on time ratio, and that is a ratio in which a temperature of an area of said heating member through which the material does not pass is less than a temperature of the area in the first turn-on time ratio, to continue controlling the electrification, and wherein after the turn-on time ratio is switched from the first turn-on time ratio to the second turn-on time ratio, when the difference between a temperature detected by said first temperature detecting means and a temperature detected by said second temperature detecting means exceeds a predetermined threshold value set according to a size of the material to be heated, said feeding device starts feeding the first sheet material to be heated.

* * * * *